US006045833A

United States Patent [19]

Landau

[11] Patent Number: 6,045,833

[45] Date of Patent: Apr. 4, 2000

[54] RECEPTACLE HAVING AROMATIC PROPERTIES AND METHOD OF USE

[76] Inventor: Steven M. Landau, 1518 Grove Ave., Rydal, Pa. 19046

[21] Appl. No.: 09/093,043

[22] Filed: Jun. 8, 1998

Related U.S. Application Data

[63] Continuation-in-part of application No. 08/874,521, Jun. 13, 1997, abandoned, which is a continuation-in-part of application No. 08/797,593, Feb. 7, 1997.

[51] Int. Cl.[7] ..... B65D 85/72

[52] U.S. Cl. ..... 426/2; 426/106; 426/112; 426/115; 426/117; 426/131; 426/132

[58] Field of Search ..... 426/112, 115, 426/106, 124, 131, 392, 397, 398, 415, 132, 2, 117

[56] References Cited

U.S. PATENT DOCUMENTS

| | | | |
|---|---|---|---|
| 2,357,258 | 8/1944 | Harris | 426/124 |
| 3,043,464 | 7/1962 | Cerasari . | |
| 3,413,128 | 11/1968 | Steinbarth et al. | 426/115 |
| 3,567,119 | 3/1971 | Wilbert | 426/115 |
| 3,599,859 | 8/1971 | Maierson . | |
| 3,603,454 | 9/1971 | Raaf | 426/106 |
| 3,730,737 | 5/1973 | Harvey et al. | 426/115 |
| 3,743,520 | 7/1973 | Croner | 426/112 |
| 4,687,203 | 8/1987 | Spector . | |
| 4,717,017 | 1/1988 | Sprinkel et al. . | |
| 4,720,423 | 1/1988 | Fraser . | |
| 4,990,345 | 2/1991 | Webb | 426/112 |
| 5,018,974 | 5/1991 | Carnahan et al. . | |
| 5,249,676 | 10/1993 | Ashcraft et al. . | |
| 5,431,276 | 7/1995 | Lialin . | |
| 5,529,179 | 6/1996 | Hanson . | |
| 5,635,229 | 6/1997 | Ray | 426/112 |
| 5,640,931 | 6/1997 | Markham . | |

FOREIGN PATENT DOCUMENTS

| | | | |
|---|---|---|---|
| 1460 | 4/1979 | European Pat. Off. | 426/124 |
| 59-155451 | 9/1984 | Japan . | |
| 63-265926 | 11/1988 | Japan . | |
| 1558960 | 1/1980 | United Kingdom . | |

OTHER PUBLICATIONS

Sustrelle Lab Manual, Jun. 1975.

*Primary Examiner*—Steve Weinstein
*Attorney, Agent, or Firm*—LaMorte & Associates

[57] ABSTRACT

A device and method for adding the perception of flavoring to a product that is consumed from a receptacle. The device is a cover for a receptacle, wherein a person can drink from a receptacle through the structure of the cover. The receptacle cover is scented with a desired fragrance. Furthermore, the receptacle cover is shaped so that a portion of the cover enters the mouth when a person is drinking through the receptacle cover. A person who consumes a product directly from the receptacle will bring the receptacle cover to his/her mouth. As the receptacle cover is taken within the mouth, the receptacle cover scents the air contained within the mouth. Simultaneously, the portion of the receptacle cover outside of the mouth scents the air surrounding the outside of the nose. By scenting the air inside the mouth and outside the nose, the nose is saturated by the desired fragrance and a more effective olfactory sense deception is obtained.

14 Claims, 6 Drawing Sheets

RECEPTACLE HAVING AROMATIC PROPERTIES AND METHOD OF USE

RELATED APPLICATIONS

This application is a continuation-in-part of U.S. patent application Ser. No. 08/874,521, entitled DRINKING RECEPTACLE HAVING AROMATIC PROPERTIES, filed Jun. 13, 1997, now abandoned, which was a continuation-in-part of U.S. patent application Ser. No. 08/797,593, entitled BOTTLE CAP CLOSURE WITH FLAVORING COMPONENT, filed on Feb. 7, 1997.

BACKGROUND OF THE INVENTION

1. Field of the Invention

The present invention relates to receptacles for holding drinkable fluids, such as cups, cans and bottles. More specifically, the present invention relates to such receptacles that contain a fragrance intended to enhance the flavor of the fluid drunk from those receptacles.

2. Prior Art Statement

Many people carry bottles of water with them as they exercise, travel or otherwise leave the confines of their home. One reason water is so often selected is that pure water does not need refrigeration and has no ingredients that can spoil. Consequently, a person can open and close the bottle of water numerous times without concern as to the quality of the contents.

The one disadvantage of drinking water is that the water has no flavor. As a result, the water is drunk mostly for the purposes of hydration. Over the years, devices have been developed that add flavor to water as the water is being drunk. Most of these prior art devices come in the form of straws, wherein a flavoring is present within the straw. As water is drawn through the straw, the water absorbs the flavoring and the person drinking the water tastes the flavoring. Such prior art devices are exemplified by U.S. Pat. Nos. 5,094,861 to D'Auguste, entitled FLAVORED DRINKING STRAW; 3,615,595 to Guttag, entitled FLAVORED DRINKING STRAW; and 4,921,713 to Fowler, entitled VERSATILE CONTROLLED FLAVOR STRAW ASSEMBLY.

Another type of prior art straw that adds flavoring to a drink is shown in U.S. Pat. No. 3,545,980, to Stanger, entitled COMBINATION STRAW AND FLAVORING. In the Stanger patent, the fluid flowing through the straw does not contact the flavoring. Rather, the flavoring material is placed in the mouth where the saliva of the mouth dissolves the flavoring and the flavoring then mixes with the fluid passing into the mouth.

The problems with the straw-based prior art flavoring devices are that in order to use such devices, the straw must be placed into the liquid being drunk. This requires a person to either bring his/her own straw or purchase a straw in addition to the beverage being consumed. Furthermore, even if such a straw were readily available, many water bottles have caps that do not have openings large enough to pass a straw through. As a result, the water would have to be poured into a container with a larger opening before it can be drunk. Another disadvantage of straw-based prior art flavoring devices is that they add calories and/or chemicals to the water. If a person does not wish to consume such calories or chemicals, then that person can not use the straw and must drink the water unflavored.

In an attempt to flavor water without adding additives to the water, devices have been developed that depend upon the physiological phenomenon of olfactory sense deception. A person's sense of taste is partially regulated by that person's sense of smell. It is a well known physiological phenomenon that a person who smells a strong aroma while eating or drinking will believe that the food or drink being consumed is flavored in a manner corresponding to that smell. In a process not fully understood by science, the human brain receives sensory input from both the nose and the mouth. If the sensory inputs do not correspond, the signals are mixed by the brain. As a result, the brain is tricked into believing that the taste of the food or drink being consumed is the source of the smell. The brain therefore assigns a false flavor to the food or drink being consumed that corresponds to that smell. For the purpose of this disclosure, such a physiological phenomenon is referred to as olfactory sense deception.

U.S. Pat. No. 5,635,229 to Ray, entitled BEVERAGE CONTAINER INCLUDING AN AFFIXED SCENT DISBURSEMENT MEANS FOR ENHANCING PERCEIVED FLAVOR OF THE BEVERAGE, shows a prior art device that relies upon olfactory sense deception. In the referenced Ray patent, an aromatic ring is placed around the neck of a bottle. As a person drinks from the bottle, they smell the aromatic ring, wherein olfactory sense deception is hopefully induced.

The olfactory sense receptors in the sinuses receive scents in two different ways. The first way is when a person inhales through his/her nose. The second way is when air enters the sinus cavity from the back of the mouth. A problem associated with prior art devices, such as that described in the Ray patent, is that the aromatic source is located only outside the nose. Therefore, the scent of the aromatic source is only perceived when a person inhales through his/her nose. Furthermore, the aromatic source of the Ray patent is only located outside of the nose, while a person is in the process of drinking.

Humans are born with the ability to breath and drink simultaneously. However, this ability is lost shortly after infancy as the anatomy of the body changes. As such, most all people over the age of two cannot drink and breath simultaneously. As such, it is not possible for a person to breath through his/her nose at the exact moment that he/she is drinking. As a result, prior art devices that position a scented object outside the nose only while a person is drinking are fundamentally flawed. Additionally, as a person in drinking or eating, the scent of the material being consumed travels into the sinus from within the mouth. Consequently, the true smell of the material being consumed is smelled and the degree of olfactory sense deception is decreased.

A need therefore exists in the prior art for a device capable of flavoring a consumable product by using a more effective method of olfactory sense deception, whereby a scent can be introduced into the sinus cavity both through the nose and through the mouth. This need is met by the present invention as described and claimed below.

SUMMARY OF THE INVENTION

The present invention is a device and method for adding the perception of flavoring to a product that is consumed from a receptacle. The device is a cover for a receptacle, wherein a person can drink from a receptacle through the structure of the cover. The receptacle cover is scented with a desired fragrance. Furthermore, the receptacle cover is shaped so that a portion of the cover enters the mouth when a person is drinking through the receptacle cover. A person who consumes a product directly from the receptacle will bring the receptacle cover to his/her mouth. As the receptacle cover is taken within the mouth, the receptacle cover scents the air contained within the mouth. Simultaneously, the portion of the receptacle cover outside of the mouth scents the air surrounding the outside of the nose. By scenting the air inside the mouth and outside the nose, the nose is saturated by the desired fragrance and a more effective olfactory sense deception is obtained.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE INVENTION

Figure 1:
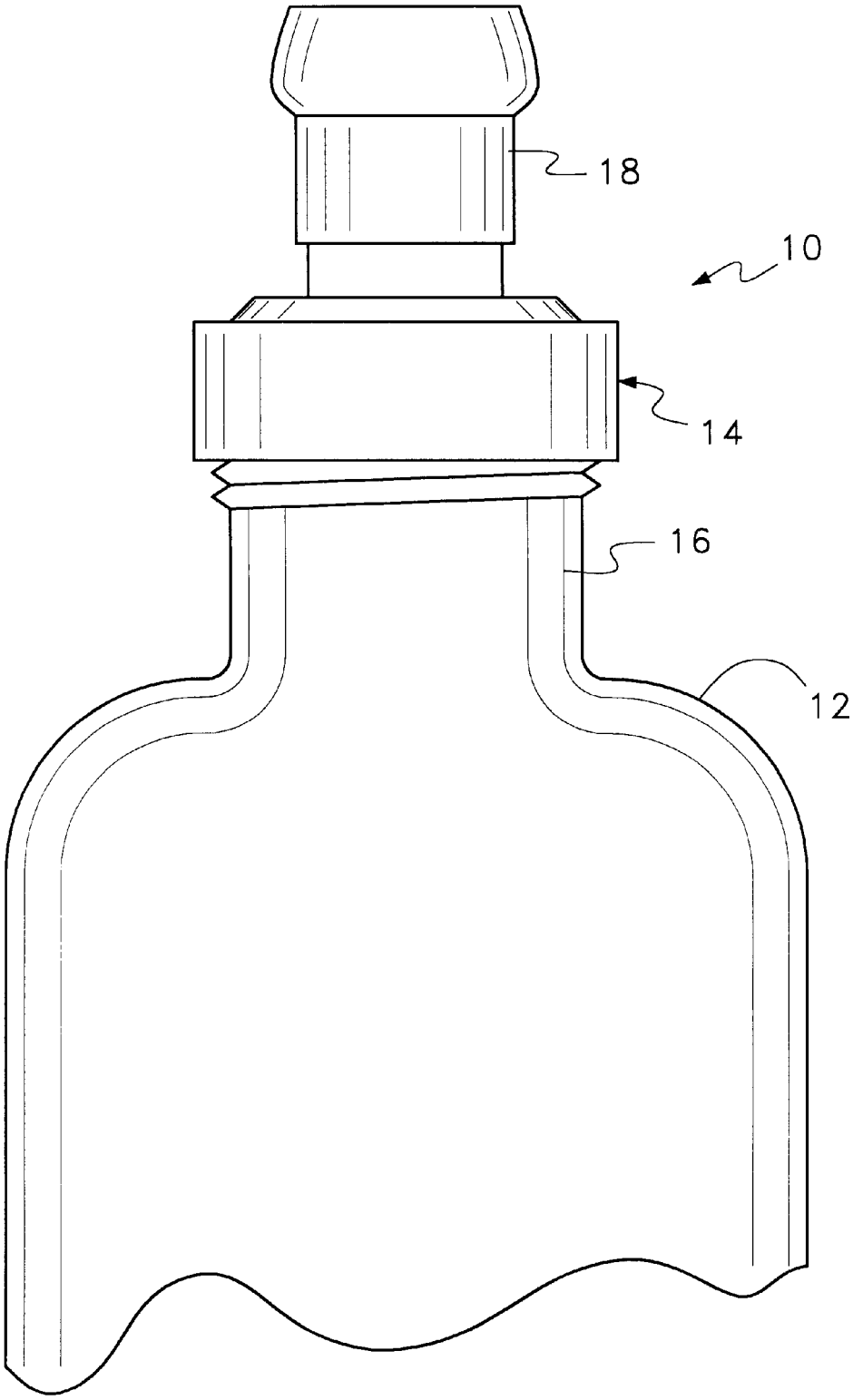
FIG. 1 is side view of a water bottle receptacle having a cap element made from fragrance impregnated plastic in accordance with the present invention.

Referring to FIG. 1, a bottle receptacle 10 is shown. The bottle receptacle 10 includes a bottle 12 for holding a liquid such as water and a cap element 14 for accessing the liquid in the bottle 12. The bottle 12 has an open end at the top of a threaded neck 16. The cap element 14 threads around the threaded neck 16 of the bottle 12, thereby selectively obstructing the flow of liquid into and out of the bottle 12. In the shown embodiment, the cap element 14 has an integrated on/off valve that is controlled by the selective positioning of a nipple head 18 on the cap element 14. Cap elements of a similar construction are well known and commonly used in the prior art. A full description of the function of the cap element is made in U.S. patent application Ser. No. 08/797,593, entitled BOTTLE CAP CLOSURE WITH FLAVORING COMPONENT, filed on Feb. 7, 1997, from which this application is a continuation-in-part.

In the present invention, the base segment and the nipple head of the cap element 14 are both molded from plastic that is impregnated with a fragrance. The fragrance is preferably that of a consumable product, such as a fruit, confection or beverage. The composition of fragrance impregnated plastic is known in the prior art. The amount of fragrance per unit weight in the plastic composition depends upon the type of plastic being impregnated and the potency of the fragrance being used. In any such composition, the amount of fragrance added to the plastic should be sufficient to provide a strongly perceivable aroma when the cap element 14 is placed within three inches of the nose.

Since the base segment and nipple head of the cap element 14 are both molded from a fragrance impregnated plastic, it will be understood that the air contained within the receptacle and the air surrounding the exterior of the cap element contain the aroma of the fragrance impregnated material.

Figure 2:
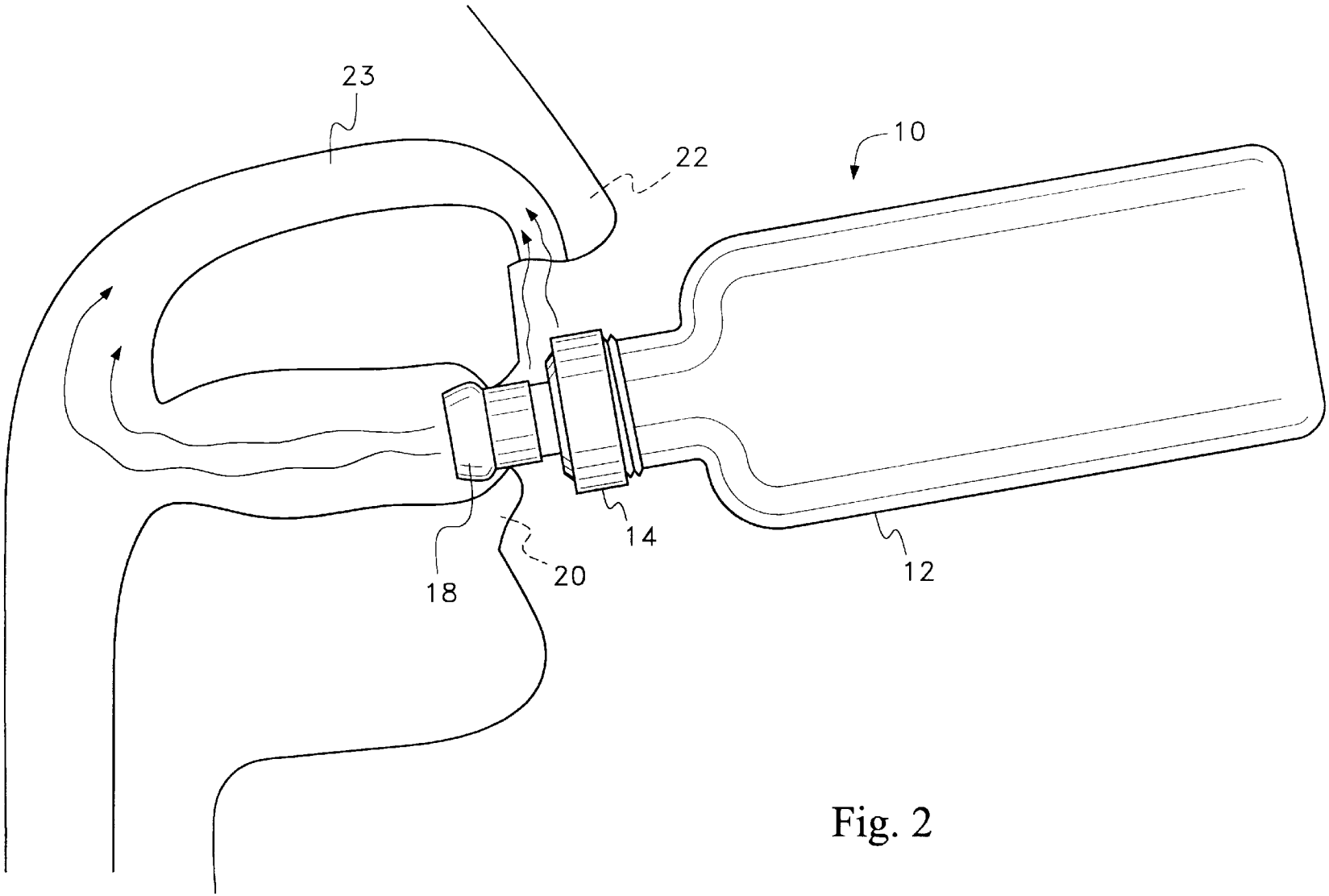
FIG. 2 is a side view of the water bottle receptacle of in FIG. 1, shown in conjunction with a person's face to show how the cap element both enters the mouth and comes into close proximity of the nose when a person drinks.

Referring to FIG. 2, it can be seen that when a person wants to drink from the bottle receptacle 10, the cap element 14 is opened and is then brought into contact with the mouth 20. When the cap element 14 is brought to the mouth 20, a portion of the nipple head 18 passes into the mouth 20. Furthermore, as the cap element 14 is brought into contact with the mouth 20, portions of the cap element 14 are inevitably brought into close proximity with the nose 22.

With portions of the cap element 14 being positioned directly outside of the nose 20, a strong aroma is provided to the air surrounding the nose 20. As such, should a person inhale through his/her nose 20 between swallows, the intake of air contains the desired aroma. Furthermore, since a portion of the nipple head 18 of the cap element 14 is present inside the mouth 20, and the nipple head 18 is also fabricated from fragrance impregnated plastic, the nipple head 18 is also emitting an aroma. The aroma emitted by the nipple head 18 combines with the air from within the receptacle that has already been scented by being in close contact with the cap element 14. The scented air fills the area within the mouth 20, wherein the aroma enters the sinus cavity 23 from the mouth. The aroma filled air contained within the mouth also mixes with exiting air as a person exhales through his/her nose 22. Furthermore, small amounts of the aroma filled air are swallowed with the liquid being consumed. As a result, the aroma is contained in any air that is belched and exhaled through the nose 22.

The saturation of the air within the mouth and the air surrounding the nose with the aroma greatly increases the ability of a person to perceive the aroma both immediately before and immediately after swallowing. As a result, the perception of the aroma dominates the natural aroma of the liquid being drunk and a more complete olfactory sense deception occurs.

As olfactory sense deception occurs, the person drinking the fluid perceives a flavor in the fluid that is not actually contained in that fluid. If the fluid being drunk is pure water, the degree of olfactory sense deception is enhanced because the water does not have a strong aroma or flavor of its own to contradict the perceived flavor created by the scented cap element 14. As a result, a person drinking a bottle of pure water will believe that the water being consumed is flavored even though no flavoring or other chemicals have been added to the water.

In the field of bottled water, it is a common practice to oxygenate water prior to bottling. One disadvantage of oxygenating water is that tends to more readily absorb a plastic flavor if stored in a plastic receptacle. By storing water in a receptacle made from a fragrance impregnated plastic, the scent of the plastic will be absorbed by the water. This will provide the water with a favorable aftertaste rather than an undesired plastic aftertaste.

Figure 3:
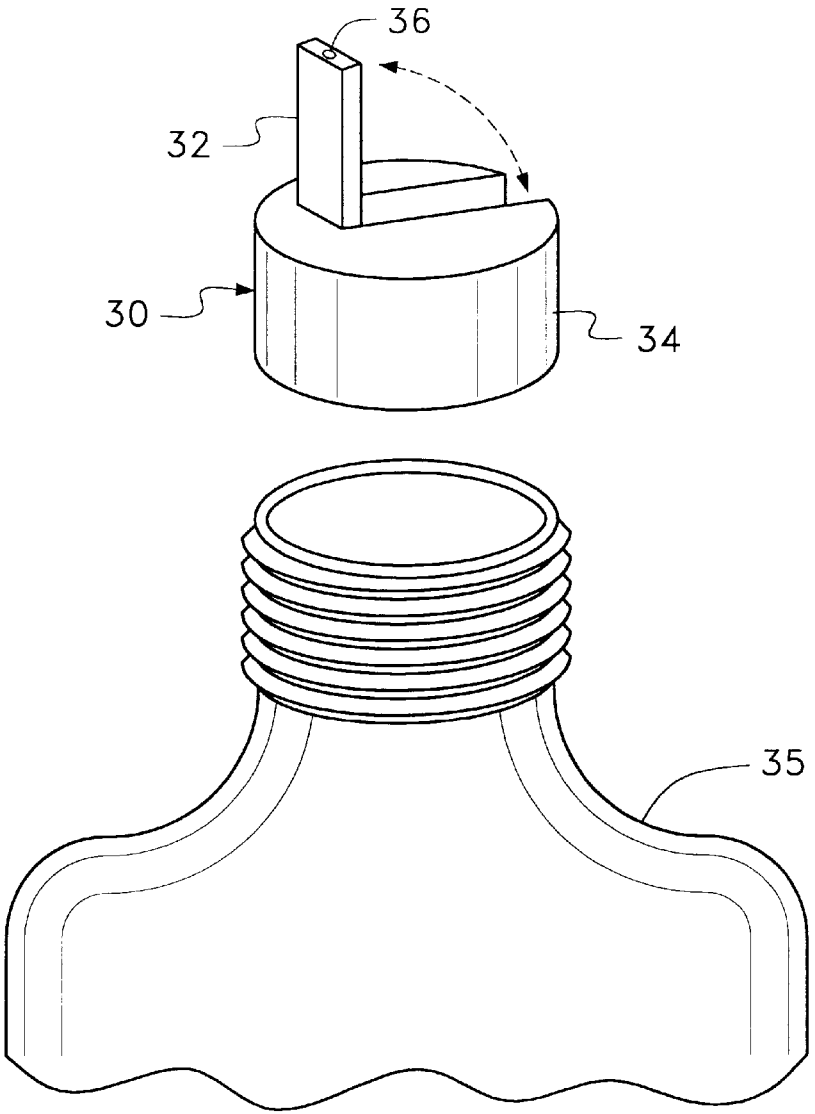
FIG. 3 is a perspective view of a first alternate embodiment of cap element in accordance with the present invention.

Referring to FIG. 3, a bottle cap 30 is shown having an integral flip-up straw element 32. Bottle caps of a similar construction are commonly used to cover containers of consumable fluid. The bottle cap 30 includes a plastic base 34 that treadably attaches to the neck of a bottle 35. The integral flip-up straw 32 is pivotably attached to the cap base 34. The flip-up straw 32 defines a conduit 36 that is open when the straw 32 is extended up and is closed when the straw 32 is folded down. To drink through the bottle cap 30, a person extends the straw 32 upwardly and drinks through the straw 32.

The flip-up straw 32 and the cap base 34 are both fabricated from a fragrance impregnated plastic. The straw 32 is placed within the mouth when a person is drinking. As a result, fragrance impregnated plastic is positioned both within the mouth and immediately outside the nose when a person drinks. The aroma of the plastic therefore fills the air within the mouth and the air surrounding the nose, thereby leading to a more effective degree of aroma saturation. This results in a more effective degree of olfactory sense deception for the reasons previously described.

Figure 4:
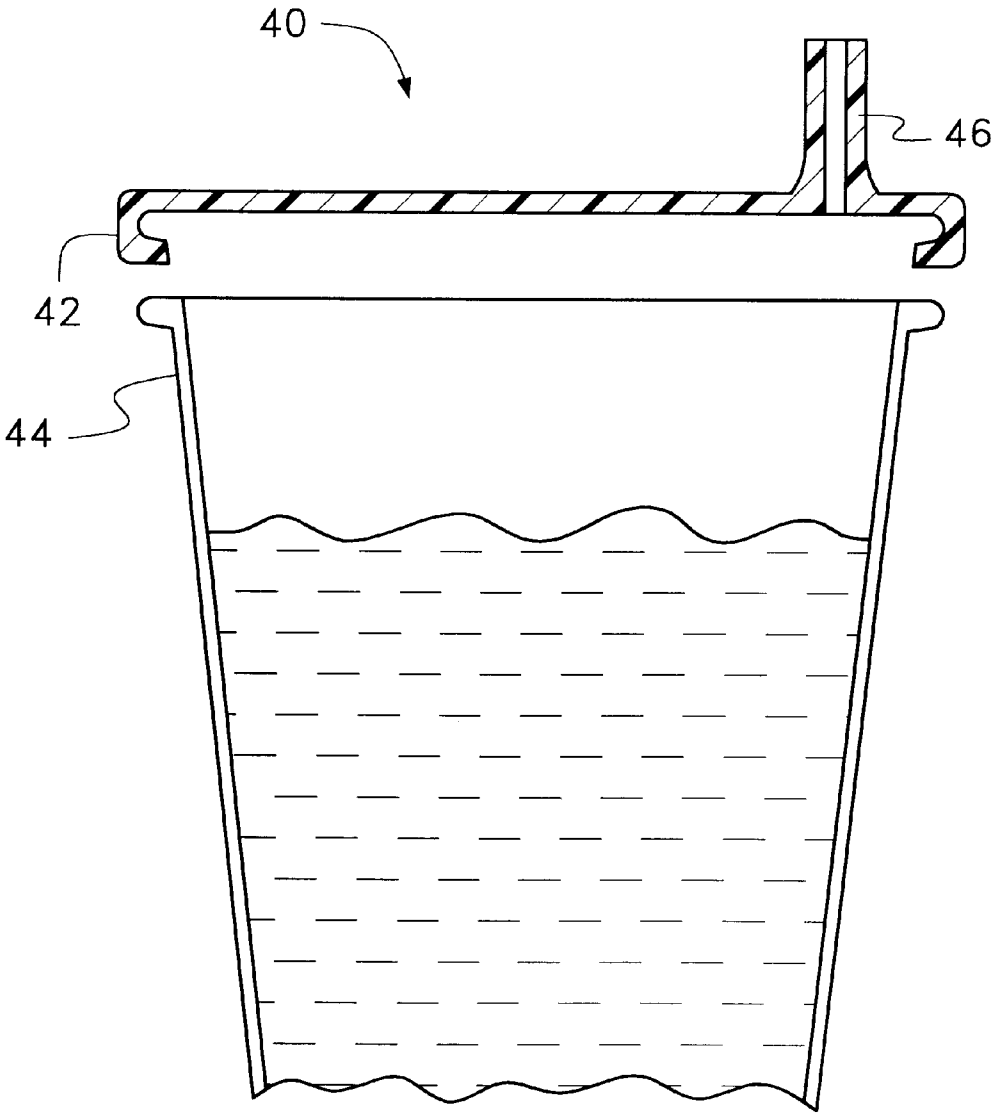
FIG. 4 is a perspective view of a second alternate embodiment of cap element in accordance with the present invention.

Referring to FIG. 4, a child's drinking cup assembly 40 is shown. The drinking cup assembly 40 contains a lid 42 that covers the base cup 44. An elongated conduit 46 extends upwardly from the lid 42. The elongated conduit 46 passes into a child's mouth when the child is drinking through the lid 42.

In the shown embodiment, the entire lid 42, including the elongated conduit 46 is made of fragrance impregnated plastic. Accordingly, when a child drinks from the cup assembly, part of the scented material of the lid is positioned outside the nose and some of the scented material from the elongated conduit is held within the mouth. The aroma of the material therefore fills the air within the mouth and the air surrounding the nose, thereby leading to a more effective degree of aroma saturation. Additionally, the air contained within the base cup 44 is scented by its close proximity with the lid 42. As liquid is drunk from the cup assembly, some of the scented air from within the base cup travels with the liquid into the mouth. The scented air mixes with the air within the mouth, thereby resulting in a stronger scent present within the mouth. This results in a more effective degree of olfactory sense deception for the reasons previously described.

Figure 5:
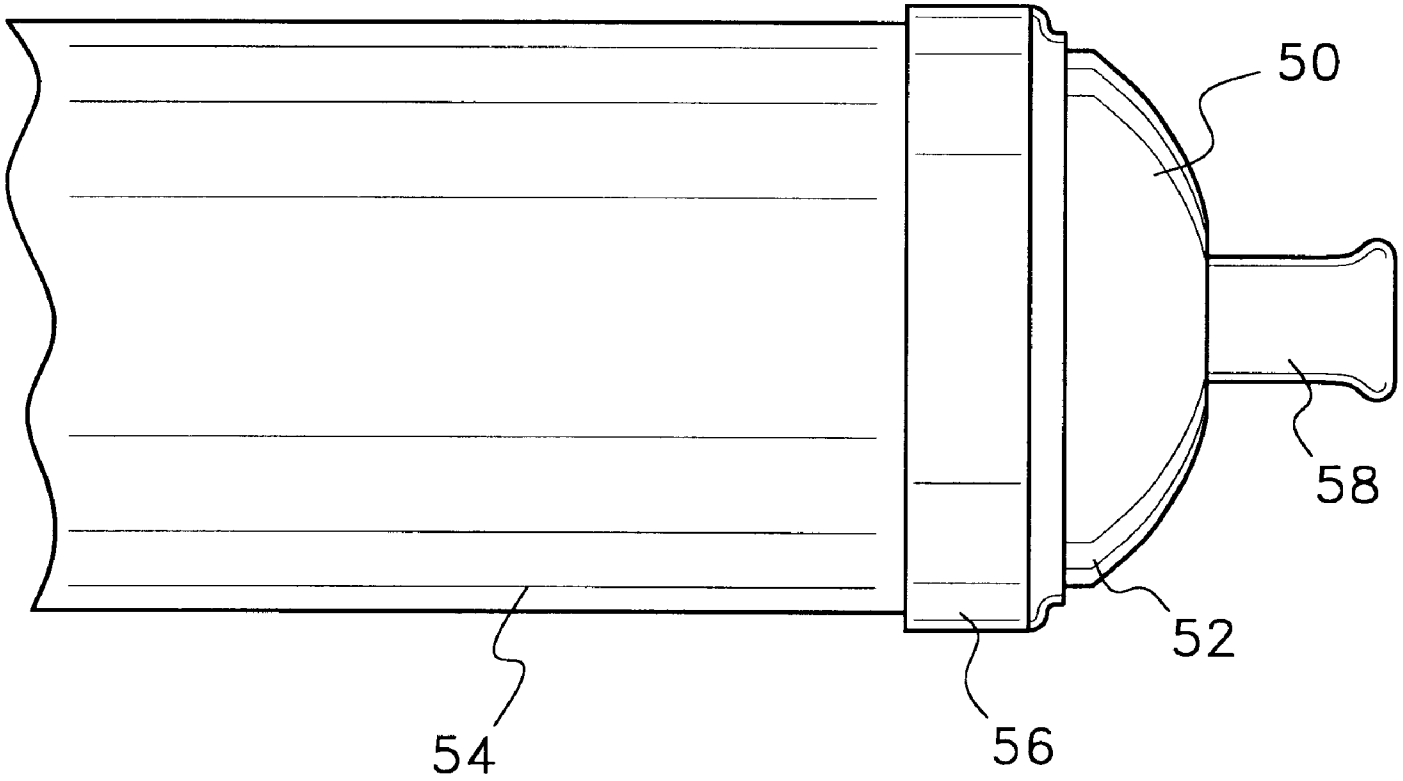
FIG. 5 is a perspective view of a third alternate embodiment of cap element in accordance with the present invention.

Referring to FIG. 5, a plastic bottle nipple 50 is shown. The nipple 50 has a base 52 that is sized to fit on a nursing bottle 54, wherein the base 52 of the nipple is held in place by a collar element 56. The nipple 50 also includes a protruding teat 58 that enters the mouth of a feeding infant. In the shown embodiment, the entire bottle nipple 50, including the teat 58 is made of fragrance impregnated plastic. Accordingly, when a child drinks from the bottle nipple 50, part of the scented nipple material is positioned outside the nose and some of the scented nipple material is held within the mouth. The aroma of the material therefore fills the air within the mouth and the air surrounding the nose, thereby leading to a more effective degree of aroma saturation. Additionally, the air contained within the bottle 54 is scented by its close proximity with the nipple 50. As liquid is drunk from the bottle, the some of the scented air from within the bottle flows with the liquid into the mouth. The scented air mixes with the air within the mouth, thereby resulting in a stronger scent present within the mouth. This results in a more effective degree of olfactory sense deception for the reasons previously described.

Figure 6:
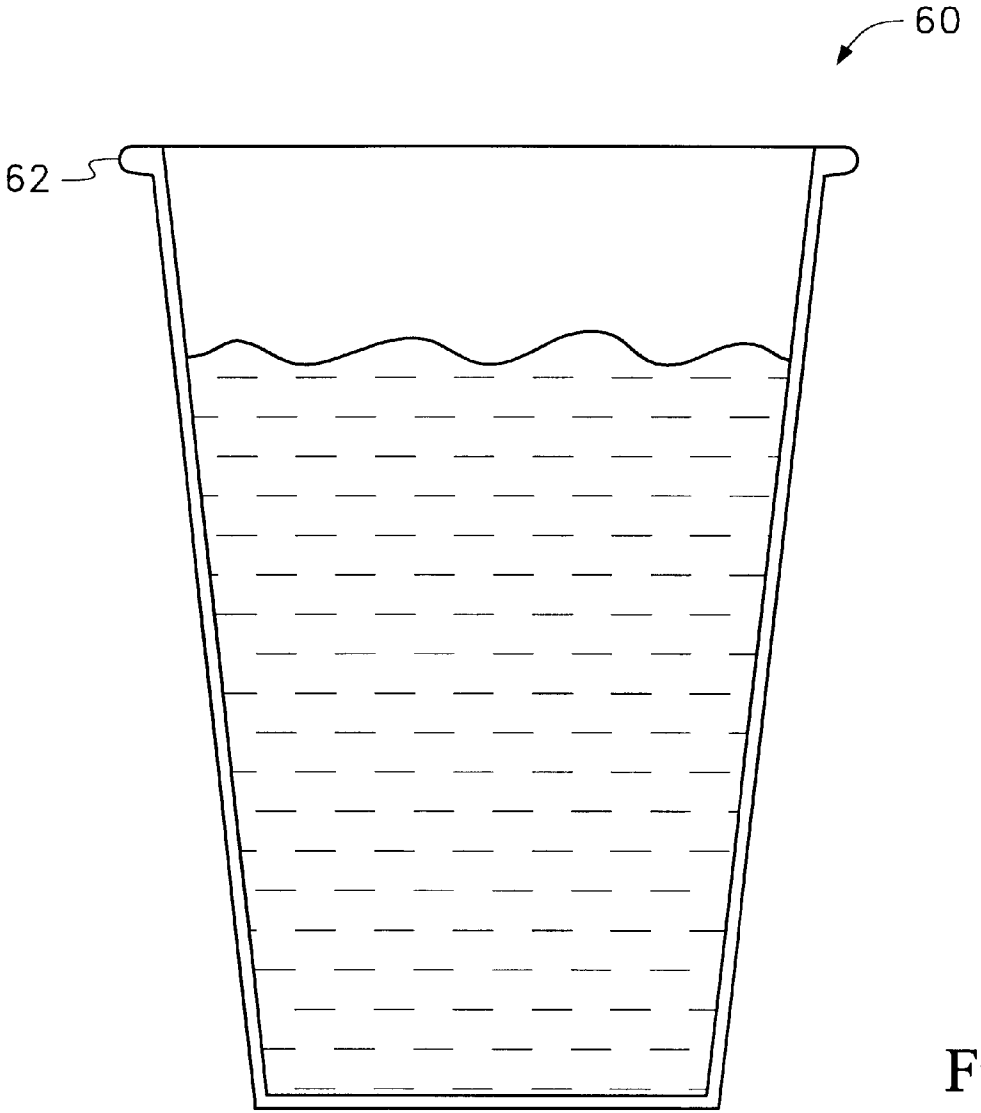
FIG. 6 is a perspective view of a fourth alternate embodiment of cap element in accordance with the present invention.

Referring to FIG. 6, an open cup 60 is shown. The cup 60 can be either entirely made of fragrance impregnated plastic or the cup can be paper based and coated with a fragrance impregnated wax. As a person drinks from the cup, the rim 62 of the cup 60 enters the mouth. The aroma from the material of the cup 60 therefore fills the air within the mouth as well as the air surrounding the nose. This results in a more effective degree of olfactory sense deception for the reasons previously described.

It will be understood that the embodiments of the present invention described and illustrated herein are merely exemplary and a person skilled in the art can make many variations to the embodiments shown without departing from the scope of the present invention. It should also be understood that the various elements from the different embodiments shown can be mixed together to create alternate embodiments that are not specifically described. All such variations, modifications and alternate embodiments are intended to be included within the scope of the present invention as defined by the appended claims.

What is claimed is:

1. A cap device for covering an open end of a fluid containing receptacle, said device comprising:

a base segment adapted to engage the fluid containing receptacle at a position where said cap device covers the open end of the fluid containing receptacle; and an extension segment extending from said base segment, said extension segment defining a conduit through which fluid flows, wherein at least a portion of said extension segment extends into a person's mouth when fluid from the fluid containing receptacle is drunk through said cap device;

wherein said base segment and said extension segment are at least partially molded from a plastic impregnated with a fragrance that emanates an aroma from both said extension segment within the mouth and said base segment outside the mouth when a person drinks the fluid through said cap device so that a perception of flavoring is added to the fluid as it is drunk.

2. The device according to claim 1, further including a mechanism for selectively opening and closing said cap device wherein fluid is free to flow through said extension segment when said cap device is positioned in an open condition and fluid is isolated in said fluid containing receptacle when said cap device is positioned in a closed condition.

3. The device according to claim 1, wherein said fragrance is selected from fruits, confections and flavored beverages.

4. The device according to claim 1, wherein said fluid containing receptacle is a bottle and said cap device is configured as a bottle cap.

5. A method of inducing olfactory sense deception in a person drinking a liquid from a receptacle, said method comprising the steps of:

providing a cap for the receptacle containing the liquid, wherein said cap is molded from a fragrance impregnated plastic;

receiving part of said cap within the mouth wherein fluid is capable of running through said cap into the mouth and wherein the part of the fragrance impregnated cap within the mouth emanates at least one perceivable aroma to air contained within the mouth while the part of the fragrance impregnated cap external of the mouth emanates the same at least one perceivable aroma to the air proximate the exterior of the mouth and the nose so that a perception of flavoring is added to the fluid as it is drunk.

6. The method according to claim 5, wherein said one perceivable fragrance selected from a group consisting of fruits, confections and flavored beverages.

7. The method according to claim 6, wherein the cap is a bottle cap attached to the receptacle which is a bottle.

8. The method according to claim 5, wherein said cap includes a mechanism for selectively opening and closing said cap wherein fluid is free to flow through said cap when said mechanism is positioned in an open condition and fluid is obstructed from flowing through said cap when said mechanism is positioned in a closed condition.

9. The method according to claim 5, wherein the receptacle is a water bottle and the fluid is water.

10. A beverage receptacle comprising:

a container having an open top end;

a cap that covers said open top end of said container and is adapted to enable fluid to be drunk therethrough, said cap having a first section that passes into a person's mouth when fluid is drunk therefrom, and a second section that remains external of the mouth, wherein said first section and said second section are both fabricated from a plastic impregnated with a fragrance that emanates aroma from both said first section in the mouth and said second section external to the mouth, when a person drinks fluid through said cap, so that a perception of flavoring is added to the fluid as it is drunk.

11. The receptacle according to claim 10, wherein the fragrance contained within said fragrance impregnated plastic is selected from a group consisting of fruits, confections and flavored beverages.

12. The receptacle according to claim 10, wherein said fluid containing receptacle is a bottle and said cap device is configured as a bottle cap.

13. The receptacle according to claim 10, wherein said fluid containing receptacle is a cup and said cap device is configured as a child's lid.

14. The receptacle according to claim 10, wherein said fluid containing receptacle is a bottle and said cap device is configured as a nipple.

* * * * *